US007486161B2

(12) United States Patent
Li et al.

(10) Patent No.: US 7,486,161 B2
(45) Date of Patent: Feb. 3, 2009

(54) REVERSE-PHASE CROSS COUPLING STRUCTURE

(75) Inventors: Chien-Chih Li, Taipei (TW); Sheng-Feng Yeh, Taipei Hsien (TW); Wei Jen, Taipei (TW)

(73) Assignee: Universal Microwave Technology, Inc., Taipei Hsien (TW)

( * ) Notice: Subject to any disclaimer, the term of this patent is extended or adjusted under 35 U.S.C. 154(b) by 192 days.

(21) Appl. No.: 11/638,533

(22) Filed: Dec. 14, 2006

(65) Prior Publication Data

US 2007/0139142 A1 Jun. 21, 2007

(30) Foreign Application Priority Data

Dec. 19, 2005 (TW) ..... 94145108 A

(51) Int. Cl.
*H01P 1/201* (2006.01)

(52) U.S. Cl. ..... 333/202; 333/203; 333/206

(58) Field of Classification Search ..... 333/134, 333/202, 203, 206–209, 212, 230
See application file for complete search history.

(56) References Cited

U.S. PATENT DOCUMENTS 4,216,448 A * 8/1980 Kasuga et al. ..... 333/203
4,450,421 A * 5/1984 Meguro et al. ..... 333/202
6,081,175 A * 6/2000 Duong et al. ..... 333/212
6,404,307 B1 * 6/2002 Wulff ..... 333/207
6,836,198 B2 * 12/2004 Engst ..... 333/202

* cited by examiner

*Primary Examiner*—Seungsook Ham
(74) *Attorney, Agent, or Firm*—Birch, Stewart, Kolasch & Birch, LLP

(57) ABSTRACT

A reverse-phase cross coupling structure includes a base, which has a resonance chamber, resonators vertically arranged in parallel in the resonance chamber, and coupling portions respectively coupled between each two adjacent resonators, each coupling portion having a top recess and a coupling hole in the top recess, and an adjustment device, which comprises a cover plate fixedly covered on the base and has through holes corresponding to the coupling holes of the coupling portions and a plurality of adjustment screws respectively inserted through the through holes of the cover plate and threaded into the coupling holes of the coupling portions to the desired elevation to regulate the amount of the reverse-phase cross coupling of the resonators. This novel reverse-phase cross coupling structure is achieved only by base and adjustment device, it is not necessary to employ extra parts as in the prior designs.

2 Claims, 8 Drawing Sheets

REVERSE-PHASE CROSS COUPLING STRUCTURE

BACKGROUND OF THE INVENTION

1. Field of the Invention

The present invention relates to the design of microwave component. A microwave component has the characteristic that its size is near the wavelength order with respect to operating frequency, and therefore it is necessary to employ the transmission line theory and electromagnetic field theory instead of AC network theory. This invention is to obtain the right coupling amount between interesting resonators by solving the electromagnetic field problem of the high frequency structure.

2. Description of the Related Art

Wireless communication is an important field in modern communication industry. Telecom related companies compete against one another to obtain channel resources. Because of limited channel resources, every telecom service provider is trying hard to fully utilize the limited bandwidth resource by increasing the communication capacity and improving the communication quality. Because the receiving and transmitting channels and channels of different operation systems are close to one another, they must be well isolated to maintain good communication quality. In order to fully utilize the limited bandwidth resource, the demand for high performance filters or duplexers is heavy. A cross-coupling design is usually used to increase the degree of isolation under a limited range. FIG. 4 is a schematic drawing showing the arrangement and a regular filter without cross coupling, the arrangement of a cross-coupling filter, and a frequency response curve comparison chart obtained from the regular filter without cross coupling and the cross-coupling filter. The part A in FIG. 4 shows resonators coupled to one another without through cross coupling. The part B in FIG. 4 shows resonators coupled together through a cross coupling technique. As illustrated, the so-called cross coupling is to insert a coupling path B3 in between two resonators that are not abutted against each other so that the cross coupling filter B has a frequency response steeper than the frequency response obtained from the regular filter A, achieving the desired high degree of isolation. In FIG. 4, part C shows the frequency response curve comparison chart obtained from the regular filter without cross coupling and the cross-coupling filter. As illustrated, A1 and A2 are frequency responses obtained at different channels from the filter A without cross coupling; B1 and B2 are frequency responses obtained at different channels from the filter after insertion of the cross coupling path. B1 stands for a low frequency channel filter, its steep response occurs at the right side, and its cross coupling excitation is same as the main coupling. This coupling is called in-phase coupling. B2 stands for a high frequency channel filter, its steep response occurs at the left side, and its cross coupling excitation is reversed to the main coupling. This coupling is called reverse-phase cross coupling. Therefore, controlling the amount of cross coupling and its phase effectively achieves the desired high degree of isolation among channels.

It is relatively easier to produce an in-phase cross coupling structure because its structure is similar to the main coupling. Normally, an opening is made on the partition wall between resonators to achieve a coupling, and an adjustment screw is provided between resonators to adjust the amount of coupling. As for reverse-phase cross coupling, it is not so straightforward as in-phase cross coupling. FIG. 5 illustrates a fixed type reverse-phase cross coupling structure and an adjustable reverse-phase cross coupling structure according to the prior art. As shown in part A in FIG. 5, a rod conductor D1 is mounted with an insulative material D2 and set between two resonators D6 to excite reverse-phase cross coupling. The amount of cross coupling is determined subject to the length of the rod conductor D1. However, this design of reverse-phase cross coupling structure D is still not satisfactory in function. When wishing to modify the amount of cross coupling, the cover must be detached from the cavity housing, and then affixed to the reverse-phase cross coupling structure after replacement of the rod conductor D1 with a different length of rod conductor. This procedure may be repeated several times before the accurate length of rod conductor is installed. This adjustment procedure is complicated. Further, frequently dismounting and mounting the cover may damage the threads of the mounting screw holes, resulting in low installation tightness. In part B in FIG. 5, a thin-film circuit board D3 is set between two resonators D6, and an adjustment screw D5 is disposed adjacent to the bar conductor D4 that is formed on the thin-film circuit board D3 through an etching technique. By means of rotating the adjustment screw D5 to perturb the EM field, thereby adjusting the coupling amount. The reverse-phase cross coupling structure D shown in part B in FIG. 5 allows quick adjustment of the coupling amount without detaching the cover, however this design still has drawbacks as follows:

1. This design of reverse-phase cross coupling structure requires installation of an additional circuit board.

2. The installation of the additional circuit board requires much time and labor. Improper installation position of the circuit board affects the performance of the filter, lowering the reliability of the product.

Therefore, it is desirable to provide a reverse-phase cross coupling structure that eliminates the aforesaid drawbacks.

SUMMARY OF THE INVENTION

The present invention has been accomplished under the circumstances in view. It is therefore the main object of the present invention to provide a reverse-phase cross coupling structure, which uses an adjustment screw to excite reverse-phase cross coupling instead of the use of a conductor between two resonators in the prior art design. By means of analyzing the EM field problem and obtaining S-parameters of a local structure of the filter, so that a suitable reverse-phase cross coupling structure is determined subject to the relative amplitude and phase between ports.

FIG. 6 is a schematic drawing showing an equivalent circuit and the corresponding electromagnetic simulation model.

Part A in FIG. 6 shows the equivalent circuit of a 7 order combline filter. Part B in FIG. 6 shows the electromagnetic simulation model of the 7 order combline filter. In this example, a cross coupling is introduced between the $3^{rd}$ resonator and the $5^{th}$ resonator to obtain a single side steep frequency response. Because it takes much time and is not practical to analyze the electromagnetic field of the whole 7 order filter, we simply select analysis of key structure of the $3^{rd}$, $4^{th}$ and $5^{th}$ resonator of the 7 order filter.

Part C in FIG. 6 shows a local part of the equivalent circuit of the 7 order filter. Part D in FIG. 6 shows the electromagnetic simulation model corresponding to part C of the equivalent circuit of the $7^{th}$ order filter. This local structure can be regarded as a 3-port network problem. Analyze the electromagnetic field of this local structure to obtain the S-parameters of this 3-port network. We define the port located at $3^{rd}$ resonator as port1, the $4^{th}$ resonator as port2, the $5^{th}$ resonator as port3. Comparing the amplitude and phase of $S_{21}$ to $S_{31}$ has the same meaning of comparing the amplitude and phase of the signal inputted through port1 and outputted through port2 to the amplitude and phase of the signal inputted through port 1 and outputted through port3, and the same meaning of comparing the cross coupling amount $CX_{35}$ to the main coupling amount $CX_{34}$. If simulation structure and corresponding equivalent circuit have the same amplitude ratio of $S_{31}/S_{21}$ and the phase difference between $S_{31}$ and $S_{21}$ to be 180° then the accurate reverse-phase cross coupling structure is obtained.

After through several tests subject to the aforesaid method, we finally create this invention capable of exciting reverse-phase cross coupling by means of one single adjustment screw. FIG. 7 is a schematic drawing showing an electromagnetic simulation model and the related S-parameters frequency response charts according to the present invention. Part A in FIG. 7 illustrates the electromagnetic simulation model. Part B in FIG. 7 illustrates the amplitude of $S_{21}$ and $S_{31}$ obtained from the electromagnetic simulation model. Part C in FIG. 7 illustrates the phase of $S_{21}$ and $S_{31}$ obtained from the electromagnetic simulation model. According to the present invention the reverse-phase cross coupling structure comprises a base, which has a resonance chamber, and coupling portions respectively coupled between each two adjacent resonators, each coupling portion having a top recess and a coupling hole in the top recess, and an adjustment device, which comprises a cover plate fixedly covered on the base and has through holes corresponding to the coupling holes of the coupling portions and a plurality of adjustment rods, for example, adjustment screws respectively inserted through the through holes of the cover plate and threaded into the coupling holes of the coupling portions to the desired depth to regulate the amount of the reverse-phase cross coupling of the resonators. By means of adjusting the elevation of the adjustment screws in the associating coupling holes, the reserve-phase cross coupling amount is relatively adjusted. Therefore, the invention can adjust the amount of the reverse-phase cross coupling easily and accurately, improving the reliability of the product. After through several tests, the reverse-phase cross coupling structure of the present invention shows the function same as the conventional reverse-phase cross coupling structures in enhancing steep frequency response. FIG. 8 is a measured frequency response chart obtained from the reverse-phase cross coupling structure according to the present invention. This frequency response chart shows high reliability of the present invention.

DETAILED DESCRIPTION OF THE PREFERRED EMBODIMENT

Figure 1:
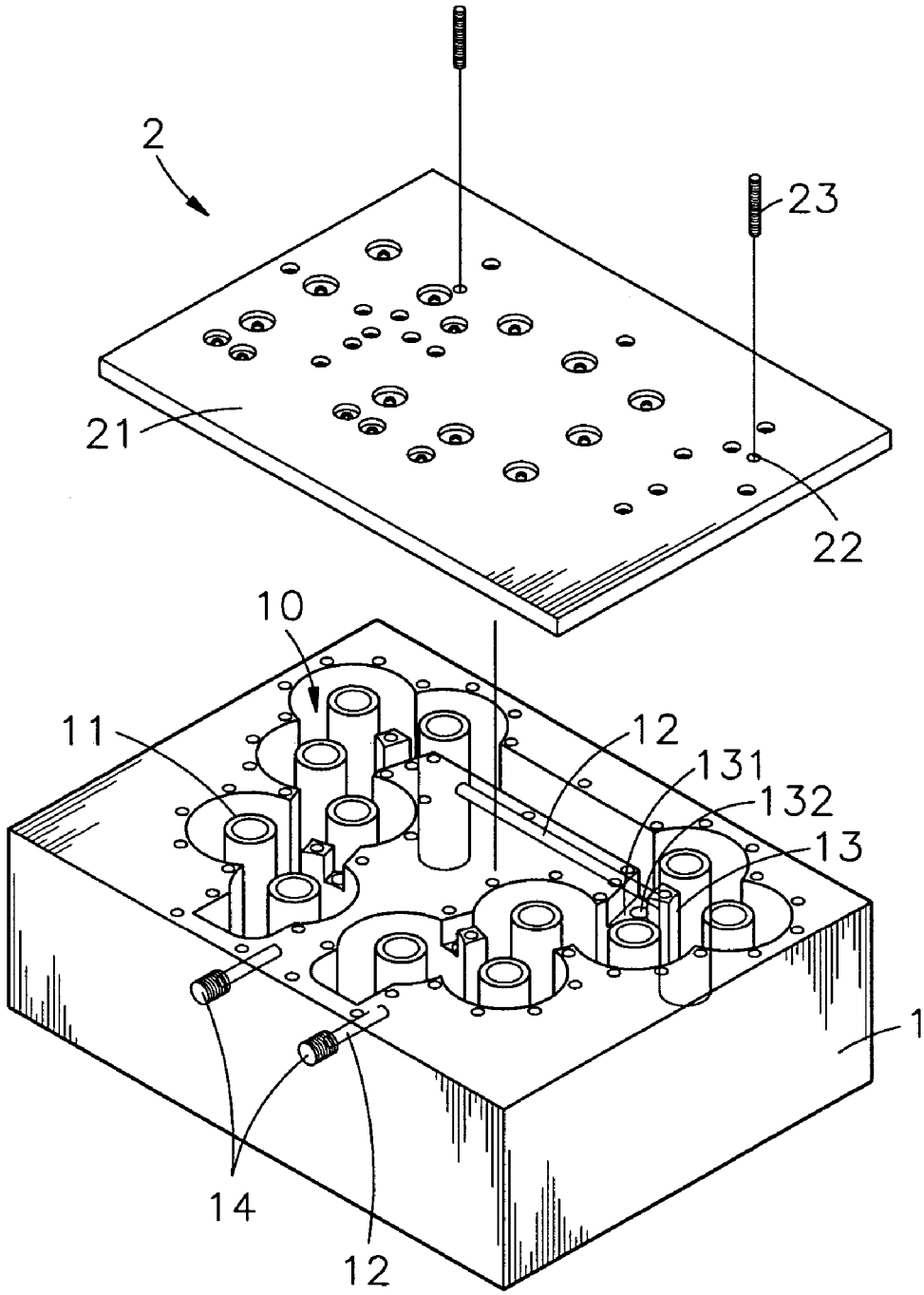
FIG. 1 is an exploded view of a reverse-phase cross coupling structure according to the present invention.
Figure 2:
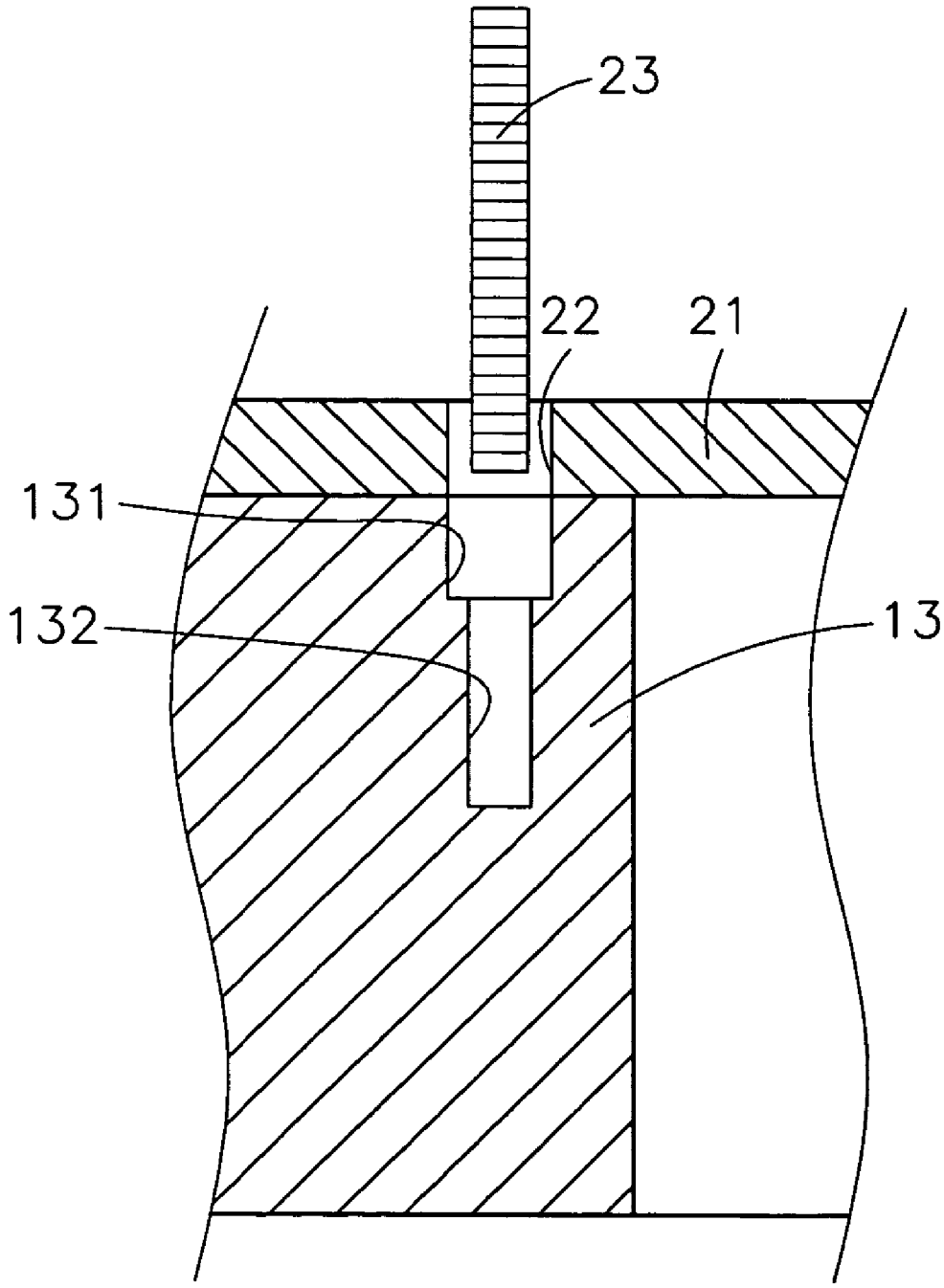
FIG. 2 is a sectional view of a part of the present invention before adjustment.

Referring to FIGS. 1 and 2, a reverse-phase cross coupling structure in accordance with the present invention is shown comprised of a base 1 and an adjustment device 2.

The base 1 has a resonance chamber 10, a plurality of resonators 11 vertically arranged in parallel in the resonance chamber 10, conductors 12 respectively connected to the resonators 11 (at the receiving side and the transmitting side), coupling portions 13 respectively coupled between each two adjacent resonators 11 in the resonance chamber 10, and input/output terminals 14 respectively connected to the conductors 12 and extended out of one side of the base 1. The coupling portions 13 each have a top recess 131 and a coupling hole 132 vertically downwardly extended from the bottom side of the top recess 131 in communication with the outside space.

The adjustment device 2 comprises a cover plate 21 fixedly covered on a top side of the base 1, which has a plurality of through holes 22 corresponding to the coupling holes 132 of the coupling portions 13 of the base 1, and adjustment rods, for example, adjustment screws 23.

During installation, the cover plate 21 of the adjustment device 2 is fixedly covered on the top side of the base 1 to aim the through holes 22 of the cover plate 21 at the coupling holes 132 of the coupling portions 13 of the base 1 respectively, and then the adjustment screws 23 are respectively inserted through the through holes 22 and threaded into the respective coupling holes 132, and rotated upwards/downwards relative to the base 1 to the desired elevation.

Figure 3:
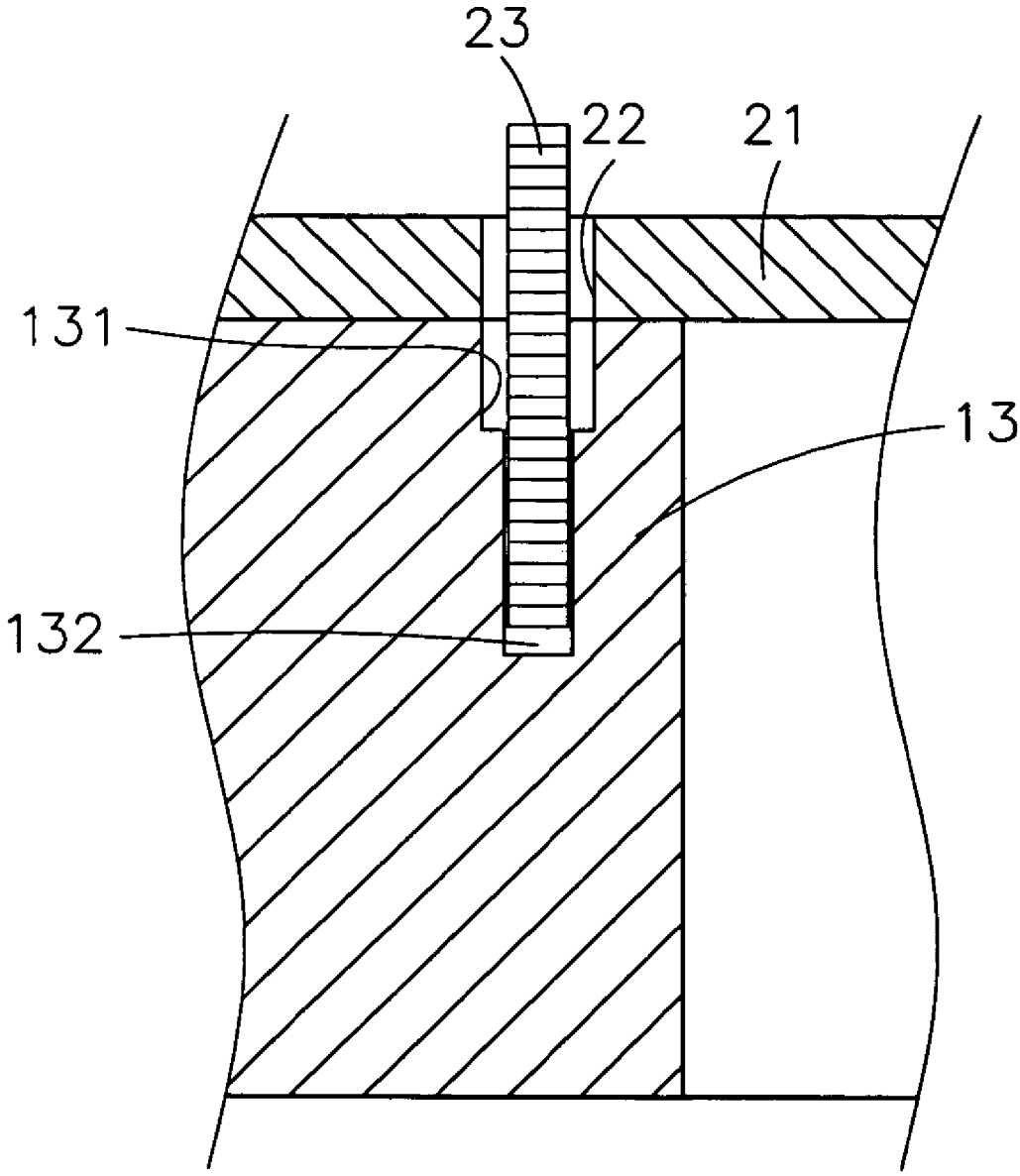
FIG. 3 corresponds to FIG. 2, showing the adjustment screw threaded into the coupling hole.
Figure 4:
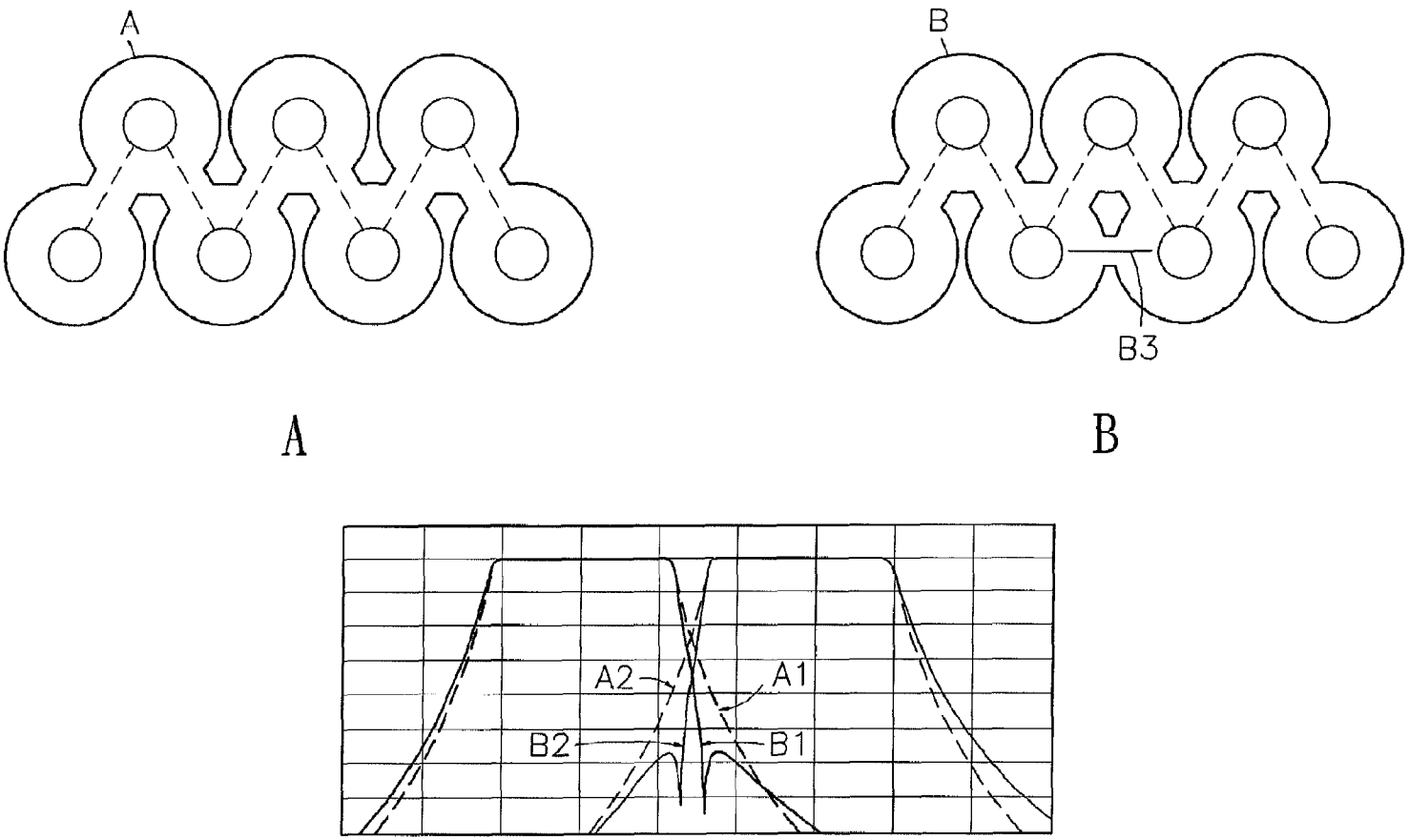
PRIOR ART FIG. 4
FIG. 4 is a schematic drawing showing a regular filter without cross coupling, a cross-coupling filter, and a frequency response curve comparison chart obtained from the regular filter without cross coupling and the cross-coupling filter.
Figure 5:
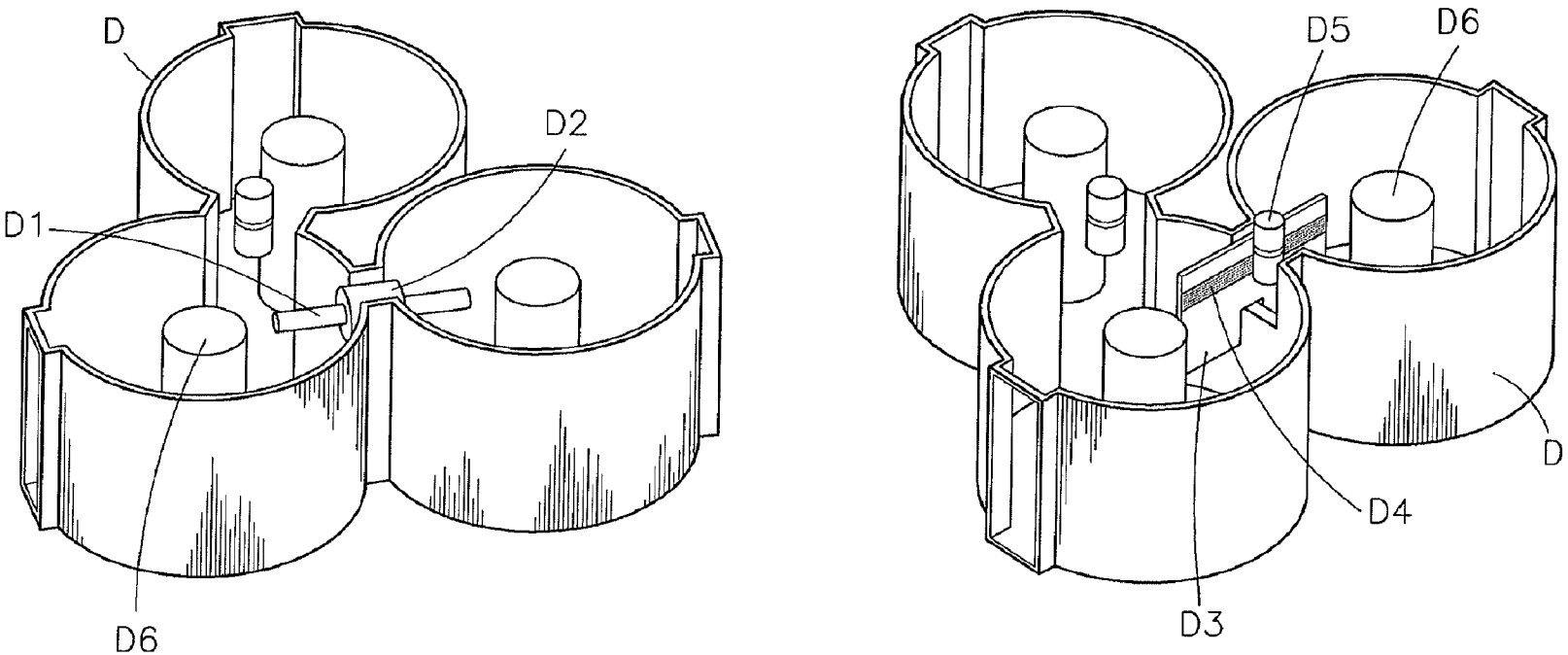
PRIOR ART FIG. 5
FIG. 5 illustrates a fixed type reverse-phase cross coupling structure and an adjustable reverse-phase cross coupling structure according to the prior art.
Figure 6:
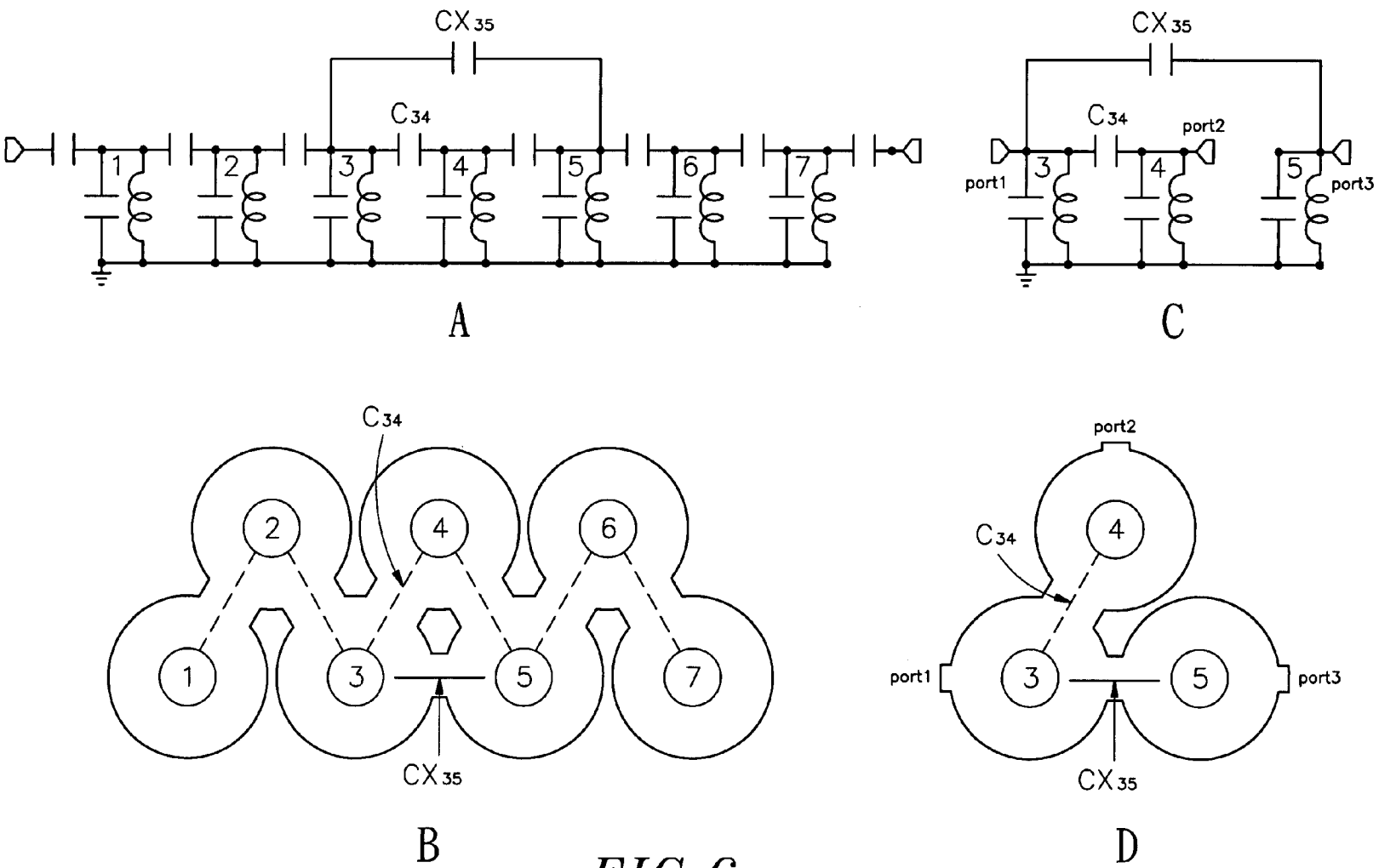
FIG. 6 is a schematic drawing showing an equivalent circuit and the corresponding electromagnetic simulation model.
Figure 7:
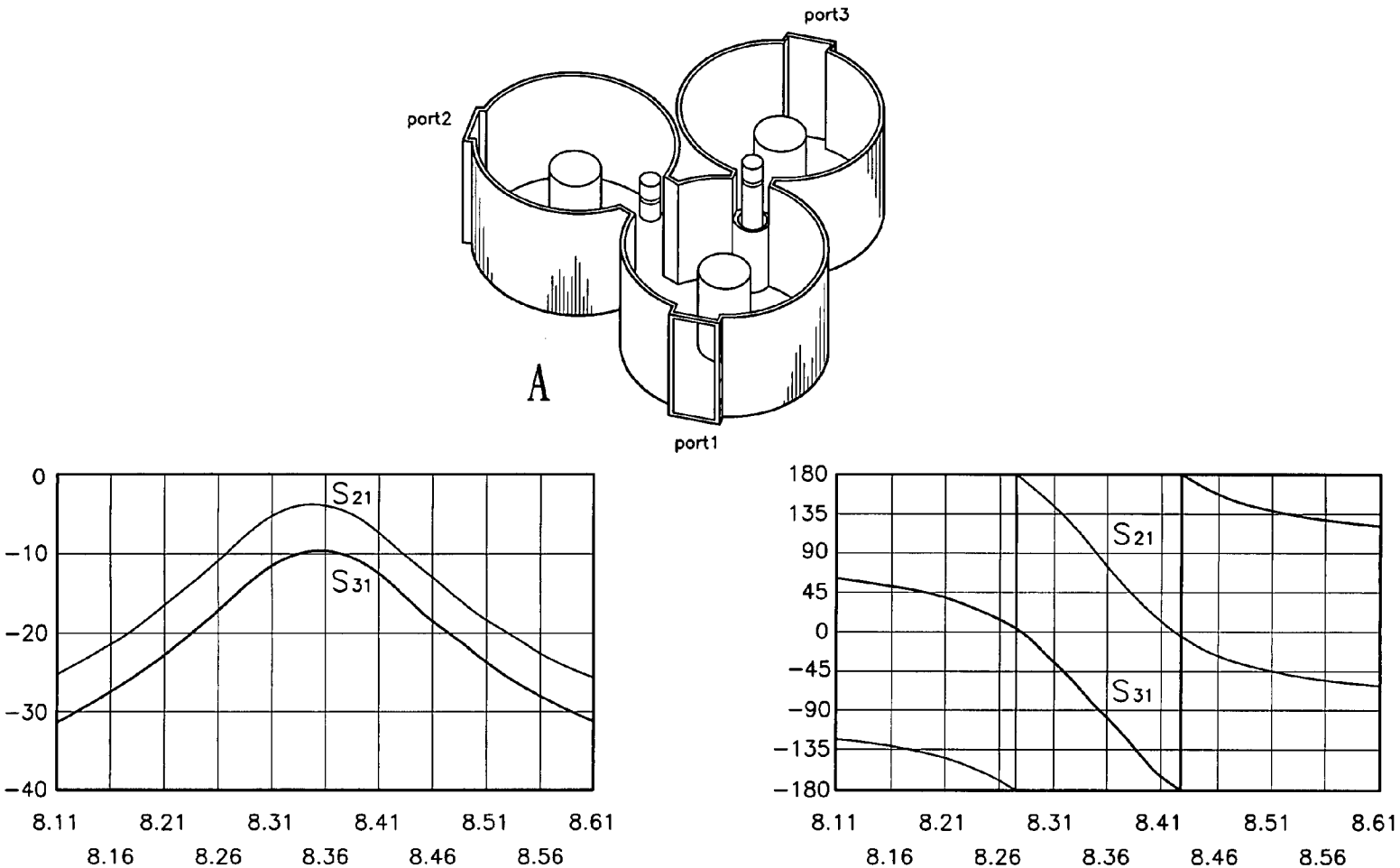
FIG. 7 is a schematic drawing showing an electromagnetic simulation model and the related S-parameters frequency response charts according to the present invention.
Figure 8:
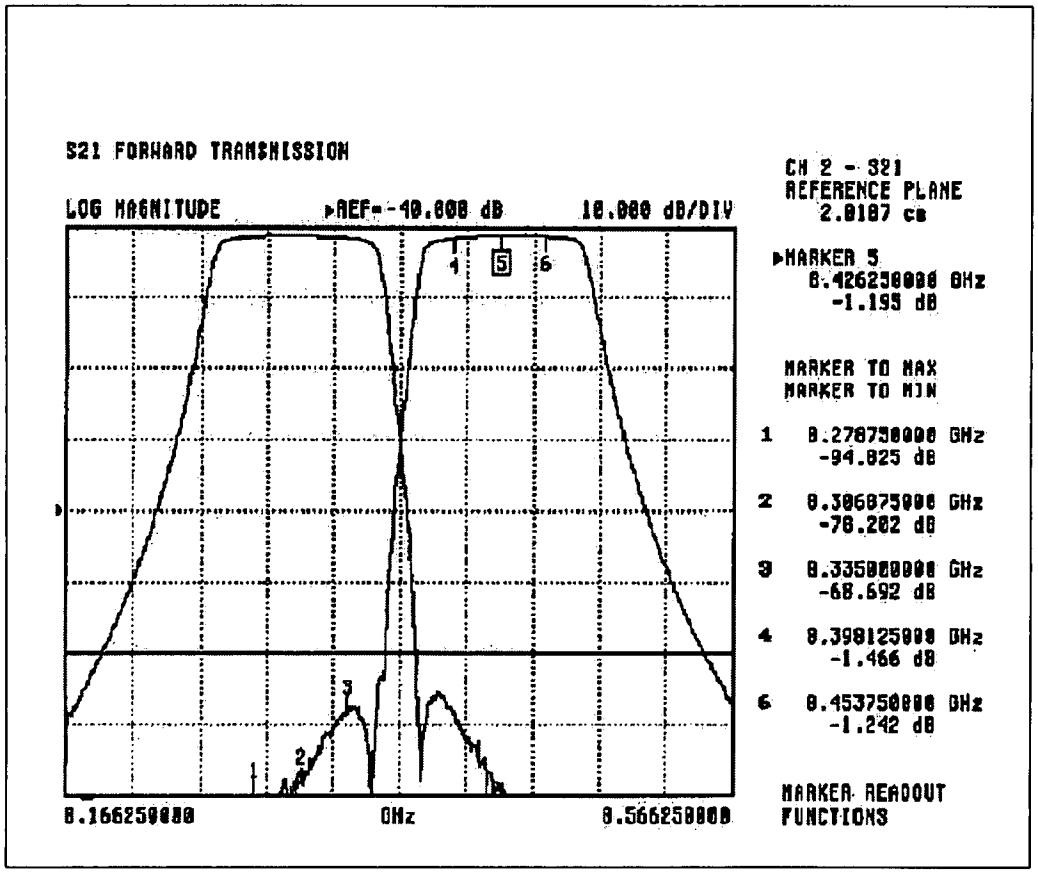
FIG. 8 is a measured frequency response chart obtained from the reverse-phase cross coupling structure according to the present invention.

Referring to FIGS. 2 and 3, by means of adjusting the insertion depth of the adjustment screws 23 in the associating coupling holes 132, the amount of the reverse-phase cross coupling is relatively adjusted, and the desired frequency response is obtained to satisfy the requirement for high isolation among channels.

When compared to the prior art designs, the invention has the follow benefits:

1. During fabrication of the base 1, the coupling portions 13 are directly made having the respective top recesses 131 and coupling holes 132, it is not necessary to employ extra parts for reverse-phase cross coupling purpose, thereby improving the manufacturing efficiency and lowering the manufacturing cost.

2. The through holes 22 of the adjustment device 2 are respectively and accurately aimed at the respective coupling holes 132 for quick installation of the adjustment screws 23. This kind of arrangements can achieve high product reliability because of not employing those extra attached parts as in the prior designs. The attached parts may be loose due to environmental stress and cause product failure.

A prototype of reverse-phase cross coupling structure has been constructed with the features of FIGS. 1~3. The reverse-phase cross coupling structure functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A reverse-phase cross coupling structure comprising:

a base, said base having a resonance chamber, a plurality of resonators vertically arranged in parallel in said resonance chamber, and a plurality of coupling portions respectively coupled between each two adjacent resonators in said resonance chamber, said coupling portions each having a top recess and a coupling hole vertically downwardly disposed in said top recess; and an adjustment device, said adjustment device comprising a cover plate fixedly covered on a top side of said base, said cover plate having a plurality of through holes corresponding to said coupling holes of said coupling portions, and a plurality of adjustment rods respectively inserted through said through holes of said cover plate and threaded into said coupling holes of said coupling portions of said base and vertically adjustable relative to said coupling portions to a desired elevation to regulate the amount of the reverse-phase cross coupling of said resonators.

2. The reverse-phase cross coupling structure as claimed in claim 1, wherein said adjustment rods are screw rods.

* * * * *